US011238761B2

(12) United States Patent
De Meerleer

(10) Patent No.: US 11,238,761 B2
(45) Date of Patent: Feb. 1, 2022

(54) CURVED SCREEN OR DOME HAVING CONVEX QUADRILATERAL TILES

(71) Applicant: SCIOTEQ BV, Kortrijk (BE)

(72) Inventor: Peter De Meerleer, Lokeren (BE)

(73) Assignee: SCIOTEQ BV

( * ) Notice: Subject to any disclaimer, the term of this patent is extended or adjusted under 35 U.S.C. 154(b) by 0 days.

(21) Appl. No.: 16/756,003

(22) PCT Filed: Oct. 12, 2018

(86) PCT No.: PCT/EP2018/077864
§ 371 (c)(1),
(2) Date: Apr. 14, 2020

(87) PCT Pub. No.: WO2019/076748
PCT Pub. Date: Apr. 25, 2019

(65) Prior Publication Data

US 2020/0242978 A1 Jul. 30, 2020
US 2021/0248933 A9 Aug. 12, 2021

(30) Foreign Application Priority Data

Oct. 17, 2017 (EP) ..... 17196913

(51) Int. Cl.
*G09F 9/302* (2006.01)
*G09F 9/33* (2006.01)
*G09F 9/35* (2006.01)

(52) U.S. Cl.
CPC ..... *G09F 9/3026* (2013.01); *G09F 9/3023* (2013.01); *G09F 9/33* (2013.01); *G09F 9/35* (2013.01)

(58) Field of Classification Search
CPC ..... G09F 9/3026; G09F 9/3023; G09F 9/35; G09F 9/33; G09F 9/302
See application file for complete search history.

(56) References Cited

U.S. PATENT DOCUMENTS 5,926,153 A 7/1999 Ohishi et al.
6,176,584 B1 1/2001 Best et al.
(Continued)

FOREIGN PATENT DOCUMENTS

CN 203799601 U 8/2014
CN 104021737 A 9/2014
(Continued)

OTHER PUBLICATIONS

European Communication for European Application No. 17196913.2, dated Nov. 13, 2020, 6 pages.
(Continued)

*Primary Examiner* — Muhammad N Edun
(74) *Attorney, Agent, or Firm* — RatnerPrestia

(57) ABSTRACT

A direct-view dome display includes a plurality of identical convex quadrilateral tiles, each tile providing a direct-view display. The tiles are arranged to provide a spherical or a partially spherical, e.g. truncated spherical or a substantially spherical dome, as well as provide a full or partial dome display over a horizontal field of view of at least 180° and a vertical field of view of at least from 0° to 30°, totaling at least 30° whereby the vertical field of view can be larger up to 140° for a truncated dome, or varying from −50° to +90° and up to 180° for a full dome, e.g. varying from −90° to +90°, and a support structure for supporting at least the lower tiles of the dome.

18 Claims, 6 Drawing Sheets

(56) References Cited

U.S. PATENT DOCUMENTS

| | | | | |
|---|---|---|---|---|
| 8,077,235 | B2 | 12/2011 | Street | |
| 2010/0208029 | A1* | 8/2010 | Marti | G02B 27/0101 348/14.02 |
| 2012/0105308 | A1 | 5/2012 | Chang | |
| 2013/0152129 | A1* | 6/2013 | Alberth | H04N 21/4532 725/41 |
| 2016/0069546 | A1 | 3/2016 | Chien et al. | |
| 2017/0059946 | A1 | 3/2017 | Lin et al. | |
| 2017/0068124 | A1 | 3/2017 | Ma et al. | |
| 2018/0341452 | A1* | 11/2018 | Welck | G06F 3/1446 |

FOREIGN PATENT DOCUMENTS

| | | | |
|---|---|---|---|
| CN | 106486030 | A | 3/2017 |
| CN | 106683582 | A | 5/2017 |
| CN | 206249824 | U | 6/2017 |
| CN | 104616600 | A | 9/2017 |
| WO | 0203121 | A2 | 1/2002 |

OTHER PUBLICATIONS

International Preliminary Report on Patentability for International Application No. PCT/EP2018/077864, dated Feb. 17, 2020, 6 pages.

International Search Report and Written Opinion for International Application PCT/EP2018/077864, dated Nov. 28, 2018, 9 pages.

Response to the Written Opinion for International Application No. PCT/EP2018/077864, dated Aug. 6, 2019, 3 pages.

Response to the Second Written Opinion for International Application No. PCT/EP2018/077864, dated Jan. 27, 2020, 3 pages.

Second Written Opinion for International Application No. PCT/EP2018/077864, dated Sep. 26, 2019, 5 pages.

* cited by examiner

CURVED SCREEN OR DOME HAVING CONVEX QUADRILATERAL TILES

This application is a U.S. National Phase application of PCT International Application No. PCT/EP2018/077864, filed Oct. 12, 2018, which claims the benefit of EP17196913.2, filed Oct. 17, 2017, both of which are incorporated by reference herein.

FIELD OF THE INVENTION

The present invention pertains to the field of curved screens especially substantially spherical or hemispherical dome displays made from direct view such as emissive surface visual display tiles which can be flat or curved in one or two directions. The present invention relates to a curved screen especially a partial or truncated or substantially spherical dome display which is fully immersive. The curved screens, especially substantially spherical dome displays or direct view or emissive surface visual displays can have a wide horizontal and vertical field of view.

BACKGROUND

Immersive visual systems are widely used in simulation applications to create out of the window images for pilots or drivers or to create visually surrounding virtual images for one or multiple users. Dome like displays allow the user to see a synthetic environment with a very large horizontal and vertical field of view.

Immersive dome-like displays that have a wide field of view and a zenith are generally made by using projection technology on a rear projected or front projected screen. Typically multiple projectors are used to fill up a complete or partial dome. The drawback of these approaches is that the projectors need to be placed at a projection distance away from the screen which substantially increases the footprint of the system, i.e. the size of the room in which the screen is mounted. Also the images from the projectors cannot be perfectly butted to each other resulting in loss of resolution. Thirdly, projectors may show drift on geometry alignment that can result in operation interruptions and the need to do regular re-alignment efforts.

Direct view technologies are typically aimed at flat screen imaging, with which the images can be butted to each other into large multiscreen flat or cylindrical displays which have limited immersive capabilities. Dome like displays with a number of different direct view display panels have been envisioned. All prior art screens use multiple panels with different shapes and sizes which limits the field of view and drives up the complexity, the cost and the edge artifacts, especially in the zenith.

US2017/068124 describes a design method for a curved display panel and a curved display device. The curved display panel comprises a curved thin film transistor array substrate, a liquid crystal layer, a curved color filter substrate, and a spacer assembly. The spacer assembly is used to maintain a predetermined distance between the curved thin film transistor array substrate and the curved color filter substrate. A display defect caused by an uneven cell thickness of the curved display panel is avoided.

US2017/059946 describes a pixel structure including an active device and a pixel electrode. The pixel electrode is electrically connected to the active device and includes a main trunk portion and branch portions. The main trunk portion includes a first extending part and a second extending part that cross each other. The plurality of branching portions is connected to the main trunk portion, and each branching portions is separated by the main trunk portion. The branching portions include a plurality of first branching part and a plurality of second branching part. The first extending part separates the first and second branching part. An included angle of at least part of the first branching part and the second extending part is $\alpha 1$, an included angle of at least part of the second branching part and the second extending part is $\alpha 2$, and $\alpha 1$ is not equal to $\alpha 2$.

U.S. Pat. No. 6,176,584 is related to a curved surface, real image, laser-based rear projection display system. A plurality of translucent panel members are assembled into a spherical dome assembly. The panels have concave inner surfaces treated with an optical medium to create a diffusion surface onto which the projected visual image is displayed to a design eye point located within the dome. The laser-based projectors have a greatly expanded focal range as compared to conventional sources of illumination. This allows the curved panel members to remain in focus when the dome is moved as much as two (2) relative to the location of the laser projector.

CN203799601 provides a spherical display screen formed by flat display panels. The spherical display screen is composed of four quadrangular spherical-surface-like screens which are spliced adjacently, angular vertexes of the quadrangular spherical-surface-like screens are all on a same spherical surface, N×m curved-edge or straight-edge quadrangular flat display panels with dot matrix display elements are mounted on the quadrangular spherical-surface-like screens, two angular endpoints of each quadrangular flat display panel are on the spherical surface of the quadrangular spherical-surface-like screens while another two angular endpoints of the same are enabled to be on a same spherical surface by pressing, and a spherical-surface display screen can be formed by cutting one part of the spherical display screen formed by the flat display panels according to needs. The spherical display screen is structured by using flat dot matrix display panels in a simple-structure manner, and sphere-like degree, size of adjacent splicing gaps and economic efficiency are balanced; most of the quadrangular flat display panels are identical in shape, thereby being suitable for mass manufacturing and maintenance replacing. However, with such a method, the sphere is no longer spherical as it is mathematically impossible to pave a sphere with identical squares.

US2016/069546 describes a 3D curved structure and an LED 3D curved lead frame for a curved surface illumination of an illumination device. First of all, an illumination circuit with banded structure of multilayer lead frame is drawn on a 3D illumination curved surface, then this curved circuit is spread into a plane circuit, the banded structure of multilayer lead frame of circuit is dismantled into a circuit pattern of single layers; the prototype of circuit patterns of each layer is processed with a conductive metal charge tape, and the prototype of banded structure of multilayer conductive frame is produced through repeated accumulation of multi-disc charge tapes, and the LED chip is installed on the installation seat to get a LED flat lead frame. Then the conductive metal is flexed into a LED 3D curved lead frame with jig and paste on the luminous curved surface followed by packaging them with transparent material.

Patent application US2012/105308 describes a spherical display device including a frame, a plurality of first display units and a plurality of second display units fixed on the frame. The first display panel units and the second display panel units being joined together and electrically connected to each other to cooperatively form a spherical structure with a spherical display surface. When the first display units and the second display units work together to corporately display an object, viewers can view the object in view angle of 360 degree.

However, this solution provides two types of tiles and the tiles are their shape is not adapted for a grid of pixels.

U.S. Pat. No. 5,926,153 discloses rear projected convex quadrilateral displays. It uses convex quadrilateral shapes of displays (trapezium, rectangular . . . ) to form a real dome, which need to be complemented with one set of triangular displays.

U.S. Pat. No. 8,077,235 discloses individual segments having a shape of one of a square, a rectangle, a triangle, a pentagon or a hexagon (whereby they cannot be all the same). The segments have to be made flexible to make the shapes fit.

SUMMARY OF THE INVENTION

It is an advantage of embodiments of the present invention to provide a direct-view dome display comprises display tiles such as convex quadrilateral display tiles requiring less different tile shapes.

In an aspect the present invention provides a direct-view dome display comprising a plurality of isosceles triangular tiles preferably identical tiles, each tile being a direct-view display, said tiles being arranged to provide a spherical, partially spherical, truncated or spheroidal (e.g. substantially spherical) dome, and a full or partial dome display over a horizontal field of view of at least 180° and a vertical field of view of at least 0° to 30°. The dome can be either self-supporting or have a support structure for supporting at least the lower tiles of the dome.

According to a preferred aspect of the present invention, there is provided a direct-view dome display comprising a plurality of convex quadrilateral tiles preferably identical convex quadrilateral tiles, each tile being a direct-view display, said tiles being arranged to provide a spherical, partially spherical, truncated or spheroidal (e.g. substantially spherical) dome, and a full or partial dome display over a horizontal field of view of at least 180° and a vertical field of view of at least 0° to 30°. The dome can be either self-supporting or have a support structure for supporting at least the lower tiles of the dome.

Identical tiles reduce the cost of manufacture and reduce the number of different tiles that must be kept in stock to replace defective tiles.

A convex quadrilateral is a polygon with four edges (or sides) and four vertices or corners. In embodiments of the present invention tiles in the form of convex quadrilaterals are used. In a convex quadrilateral, all interior angles are less than 180° and the two diagonals both lie inside the convex quadrilateral.

A spheroid, or ellipsoid of revolution, is a quadric surface obtained by rotating an ellipse about one of its principal axes; in other words, an ellipsoid with two equal semi-diameters. If the ellipse is rotated about its major axis, the result is a prolate (elongated) spheroid. If the ellipse is rotated about its minor axis, the result is an oblate (flattened) spheroid. A spheroid has circular symmetry.

The convex quadrilateral tiles can advantageously be tessellations of a curved surface such as a spherical, partially spherical, truncated or spheroidal (e.g. substantially spherical) dome. A curved screen especially spherical, partially spherical, truncated or spheroidal (e.g. substantially spherical) a dome display of embodiments of the present invention can be fully immersive and can provide a visual display that has a wide horizontal and vertical field of view. Preferably there are no visible transparent or visible opaque seams between the convex quadrilateral tiles.

Embodiments of the present invention provide a way to construct a dome like immersive display that is entirely built up of a single type of identical convex quadrilateral direct viewing panels, whereby the display is preferably seamless and the tiles are preferably curved around one or two axes when installed. This dome like immersive display has little or no field of view limitations and has a uniform image all around or substantially around the dome, e.g. over a horizontal field of view of at least 180° and a vertical field of view of at least 0° to 30°.

Convex quadrilateral display tiles have the advantage over non-convex quadrilateral display tiles because images are typically presented in a rectangular format with a fixed number of lines and columns. Using tile shapes that are not convex quadrilateral creates more loss in the image content of the presented images.

In an embodiment of the present invention, the convex quadrilateral tiles are flat. It is an advantage to have flat tiles as they are easy to manufacture although it is preferred that they are curved in one or two directions or around one or two axes when installed. The two directions or axes can be orthogonal.

In another embodiment of the present invention, the convex quadrilateral tiles are curved in one direction or around one axis. It is an advantage of having cylindrical tiles to provide a dome having a shape closer to a sphere while still being easy to manufacture. It is possible to manufacture the tiles on a flat plane and curve them in one direction or around one axis after the tiles have been manufactured. In this case the shape of the flat manufactured tile takes into account the final to be reached shape of the tile when finally curved in one direction so that this shape is exactly obtained after the tile is curved into one direction.

In another embodiment of the present invention, the convex quadrilateral tiles are curved in two directions or around two axes such as barrel form, spheroidal or spherical form. The two directions or axes can be orthogonal. Advantageously, curved tiles in two directions or around two axes may perfectly reproduce a spherical dome or any other desired shape.

It is an advantage of this embodiment that the convex quadrilateral tiles are spherical, elliptical, toroidal or have a freeform. Depending on the application, any desired shape can be provided with such tiles.

In an embodiment of the present invention, the support structure is a floor support structure at least partially in the shape of a ring and having a mechanical interface configured to connect to the lower convex quadrilateral tiles, and wherein the remainder of the tiles are connected together in a self-supporting way.

It is an advantage of the embodiment of the present invention that the dome does not require an external structure for the tiles but can be assembled by means of tiles in a self-supporting structure. These self-supporting tiles preferably have no visible transparent or visible opaque seams between the tiles.

In a specific embodiment, the tiles are connected together and to the floor support structure through one or more reference connectors such as pins provided in the side edges of each tile or of the support structure that connect to one or more corresponding reference holes in the side edges of the adjacent connecting tile or support structure or vice versa. Such connectors can be quick fit such as snap connectors. It is an advantage that this type of connection for the tiles permits a very quick and easy installation. Also it is an advantage that the tiles can be connected without visible opaque or transparent seams between the tiles by using hidden fasteners or fixing means, e.g. pins can be provided in the side edges of each tile that are inserted into to one or more corresponding reference holes in the side edge of the adjacent connecting tile. No separate visible opaque seam is required or made and no visible transparent seam needs to be created. As the tiles are opaque they can be connected by fasteners or fixing means such as adhesive, pins and holes, nuts and bolts, or screws, whereby these fixing means can optionally be used to secure fixtures such as brackets mounted on the back surface of the tiles hidden away from the direct view faces of the tiles.

In a specific embodiment, the plurality of convex quadrilateral tiles preferably identical convex quadrilateral tiles are combined in groups of a number less than ten such as five to form a pentagonal combination or in groups of three to form a triangular combination, and these pentagonal or triangular combinations are then positioned on top of the floor support structure and fixed together such as with fasteners or fixing means such as adhesive, pins and holes, nuts and bolts, or screws etc. The fasteners or fixing means such as adhesive, pins and holes, nuts and bolts, or screws etc, are mounted on the back surface of the tiles hidden away from the direct view faces of the tiles. No separate visible opaque seam is required and no visible transparent seam needs to be created. For example, fixing means can also include one or more reference pins provided in the side edges of the pentagonal or triangular combination or of the support structure that connect to one or more corresponding reference holes in the side edges of the adjacent pentagonal or triangular combination or support structure. It is an advantage of this specific embodiment to assemble the tiles in groups. This way of assembling the tiles further increases the speed and ease of installation.

In yet another embodiment of the present invention, the dome with self-supporting tiles or with a support structure is at least partially in the shape of a sphere, or a convex hexecontahedron or a shape substantially similar to any of the preceding shapes over a horizontal field of view of at least 180° and preferably a vertical field of view of at least 0 to 30°, the plurality of convex quadrilateral tiles preferably identical convex quadrilateral tiles being fixed together or fixed to the support structure to provide a spheroidal, substantially spherical or a spherical full or partial dome display over the field of view. The total vertical view of the display is preferably at least 30° but can be larger, e.g. up to 140° for a truncated system, varying from −50° to +90° and up to 180° for a full dome, e.g. varying from −90° to +90°. The vertical view could be 50° (e.g. 50° downwards) to +90° (e.g. 90° upwards) and up to 180° for a full dome varying from −90° (e.g. 90° downwards) to +90° (e.g. 90° upwards).

A suitable convex hexaconahedron which can be for use in any of the embodiments of the present invention to form a dome includes:

a deltoidal hexecontahedron dome—having kite shaped panels which are convex quadrilaterals a pentagonal hexecontahedron dome—having pentagon panels which are similar to convex quadrilaterals a triakis icosahedron dome—having isosceles triangular panels a pentakis dodecahedron dome—having isosceles triangular panels.

Of these the deltoidal or the pentagonal are preferred.

It is an advantage of providing a support structure in the shape of a sphere or a convex hexecontahedron, e.g. as listed above or a shape substantially similar to any of the preceding shapes as such a support structure may be more adapted for larger domes, as it provides more rigidity to the dome.

In a specific embodiment, the structural elements of the supporting structure are straight or curved. It is an advantage that straight elements are easy to manufacture whereas curved elements can be used to embrace the shape of the dome.

The tiles can advantageously be fixed, e.g. adhered, pinned, screwed or bolted to or hung from the support structure individually, or in groups such as in groups of three in a triangular configuration or in groups of five in a pentagonal configuration. It is an advantage that the installation of such a dome display is very simple. Furthermore, by grouping the tiles the installation time can further be improved.

In an embodiment of the present invention, said dome comprises an articulated entrance door. It is an advantage that such an entrance door is provided to easily enter the dome.

Preferably, said entrance door comprises three or five tiles arranged in a triangular or pentagonal configuration.

In a specific embodiment, the entrance door is encapsulated in the dome.

In an embodiment of the present invention, the dome is a complete sphere or substantially complete sphere and comprises 60 identical tiles or is spheroidal in shape.

In another embodiment of the present invention, the dome is truncated, i.e. the dome terminates at a slice through the dome, e.g. a slice through a spherical or spheroidal dome.

It is an advantage that any field of view can be provided with the dome according to the present invention, depending on the type of application.

In an embodiment of the present invention, the convex quadrilateral tiles each have an image forming direct view layer at the inside of the direct-view dome display.

In another embodiment of the present invention the convex quadrilateral tiles each have an image forming direct view layer on the outside of the direct-view dome display. In this case the support structure can be placed on the inside of the dome.

In another embodiment of the present invention the image on the direct view dome display is displayed at a frame rate synchronized with the shuttering frame rate of shutter glasses worn by the viewer or viewers to display alternating images for the left and right eye thus provide an additional depth cue for the viewer or viewers.

The direct view display tiles of any of the embodiments of the present invention can be fixed format displays. Direct view displays can be electronic visual displays that can be observed directly and present visual information according to an electrical input signal (analog or digital) either by emitting light (then they are called active displays) or, alternatively, by modulating available light during the process of reflection or transmission (light modulators are called passive displays).

A further feature of the present invention is that the tiles have an orthogonal pixel structure.

Another feature is that the tiles have a hexagonal pixel structure, said structure being such that each central pixel is surrounded by six pixels to form a hexagon, of which said central pixel is the center of gravity.

Yet another feature is that the convex quadrilateral direct view tiles have a varying pixel structure which optimizes the pixel distribution near the edges of the convex quadrilateral tile, e.g. within 200, 100, 50, 30, or 20 pixels of an edge.

It is an advantage that the pixel structure is selected to optimize the pixel distribution near the edges of the convex quadrilateral tile.

Preferably, the convex quadrilateral tiles are monolithic.

Advantageously, the direct view tiles are made up of several sub-tiles that are arranged within a convex quadrilateral configuration.

A further feature is that the direct view tiles are made up of individual light sources that are arranged within a convex quadrilateral configuration.

A further feature is that the tiles can emit visible such as red, green, blue light or non-visible light wavelengths or can have a combined output of any of these.

Preferably, each tile displays a part of the image that corresponds to its location within the dome.

More preferably, pixels near the edge or corners of the convex quadrilateral direct view tiles (e.g. within 200, 100, 50, 30, or 20 pixels of an edge) are driven at a higher brightness compared with other pixels further away from the edge of the direct view tile.

It is an advantage of driving the pixels near the edges of the tiles with a higher brightness to compensate for the reduced density of pixels near the edges. Thus, to the viewer, the direct view dome display will appear continuous and smooth. The gaps at the edges are preferably not visible. Although there can be a reduced density of pixels near the edges of the tiles there are preferably no visible transparent or visible opaque seams between the tiles.

According to an aspect of the present invention, there is provided a method of operating a direct-view dome display comprising a plurality of convex quadrilateral tiles preferably identical convex quadrilateral tiles, each tile being a direct-view display, said tiles being arranged to provide a spherical, spheroidal or substantially spherical or truncated spherical or spheroidal dome, and a full or partial dome display over a horizontal field of view of at least 180° and a vertical field of view of at least 0 to 30°. The tiles may be self-supporting or fixed to a support structure for supporting at least the lower tiles of the dome, the method comprising driving each of the convex quadrilateral tiles preferably identical convex quadrilateral tiles with image data to provide a combined image. This means that the total vertical view of the display is at least 30° but can be larger, e.g. up to 140° for a truncated system, varying from −50° to +90° and up to 180° for a full dome, e.g. varying from −90° to +90°. Preferably there are no visible transparent or opaque seams between the tiles in the direct-view dome display. If tiles are grouped in combinations and the combinations fixed to each other, preferably there are no visible transparent or opaque seams between the groups in the direct-view dome display.

According to another aspect of the present invention a method of assembling a direct-view dome display from a plurality of convex quadrilateral tiles preferably identical convex quadrilateral tiles is provided, the tiles being adapted to be driven with image data to provide a combined image each tile being a direct-view display, the method comprising arranging said tiles to provide a spherical, spheroidal or substantially spherical dome, and a full or partial dome display over a horizontal field of view of at least 180° and a vertical field of view of at least 0° to 30°, totaling at least 30° vertical field of view, and supporting at least the lower tiles of the dome.

The convex quadrilateral tiles can be curved in one direction or the convex quadrilateral tiles can be curved in two directions, or wherein the convex quadrilateral tiles are partly spherical, elliptical, spheroidal, toroidal or have a freeform.

The convex quadrilateral tiles can be manufactured in a flat plane out of a flexible material and installed curved in one or two directions or wherein the convex quadrilateral tiles are manufactured in a flat plane out of a flexible material and are installed partly spherical, elliptical, spheroidal, toroidal or have a freeform.

The support structure can be a floor support structure at least partially in the shape of a ring and can have a mechanical interface configured to connect to the lower convex quadrilateral tiles. The remainder of the tiles can be connected together in a self-supporting way or the tiles can be connected together and to a support structure such as the floor support structure through one or more connectors. Such connectors can have reference pins provided in the side edges of each tile or of the support structure that connect to one or more corresponding reference holes in the side edges of the adjacent connecting tile or support structure. The tiles can be connected by other fastening means such as by adhesive, screws, or bolts.

The plurality of convex quadrilateral tiles preferably identical convex quadrilateral tiles can be combined in groups of five to form a pentagonal combination or in groups of three to form a triangular combination, and these pentagonal or triangular combinations are then positioned on top of the floor support structure and fixed together by a fastening means or by adhesive, screws, bolts or fixed together by means of one or more reference pins provided in the side edges of the pentagonal or triangular combination or of the support structure that connect to one or more corresponding reference holes in the side edges of the adjacent pentagonal or triangular combination or support structure.

The dome or the support structure is assembled in at least partially in the shape of a sphere, a dodecahedron, an icosahedron or a convex hexecontahedron or a shape substantially similar to any of the preceding shapes over a horizontal field of view of at least 180° and a vertical field of view of at least 0° to 30° totaling at least 30°.

The plurality of convex quadrilateral tiles preferably identical convex quadrilateral tiles can be fixed to the support structure to provide a spheroidal, substantially spherical or a spherical full or partial dome display over the field of view.

The tiles can be connected to or hung from the support structure individually, in groups of three in a triangular configuration or in groups of five in a pentagonal configuration.

The dome can be provided with an articulated entrance door, consisting of 1 or multiple tiles, or wherein said dome comprises an entrance door encapsulated in said dome or wherein said dome comprises an entrance door with three or five tiles arranged in a triangular or pentagonal configuration.

The dome can be formed as a complete sphere or spheroid or substantially complete sphere and can be assembled from 60 identical tiles. Such a dome can have a truncated form.

The convex quadrilateral tiles can each have an image forming direct view layer at the inside of the direct-view dome display or wherein the image forming direct view layer is at the outside of the direct-view dome. If the direct view layer is on the inside of the dome the support structure can be provided on the outside. If the direct view layer is on the outside of the dome the support structure can be provided on the inside.

The tiles can have an orthogonal pixel structure or wherein the tiles have an hexagonal pixel structure, said structure being such that each central pixel is surrounded by six pixels to form a hexagon, of which said central pixel is the center of gravity.

The convex quadrilateral direct view tiles can have a varying pixel structure which optimizes the pixel distribution near the edges of the convex quadrilateral tile, this pixel configuration being orthogonal or close to orthogonal near the corners of the convex quadrilateral direct view tile that are at 90° or close to 90° and varying across the tile to a hexagonal pixel configuration or nearly hexagonal pixel configuration at the opposite corners that are different from 90° or substantially different from 90° to match the edges near these corners.

The convex quadrilateral tiles can be manufactured in a monolithic form, meaning that they are made in a single piece or wherein the direct view tiles are made up of several sub-tiles that are arranged within a convex quadrilateral configuration or wherein the direct view tiles are made up of individual light sources that are arranged within a convex quadrilateral configuration.

The tiles can emit red, green, blue or non-visible light wavelengths or can have a combined output of any of these or wherein each tile displays a part of the image that corresponds to its location within the dome.

The technical effects and advantages of embodiments of according to the present invention correspond mutatis mutandis to those of the corresponding embodiments of the method according to the present invention.

BRIEF DESCRIPTION OF THE FIGURES

These and other technical aspects and advantages of embodiments of the present invention will now be described in more detail with reference to the accompanying drawings, in which:

FIG. 7 is a convex quadrilateral tile or direct view panel comprising pixels arranged in an orthogonal structure according to an embodiment of the present invention, and FIG. 8 is a convex quadrilateral tile or direct view panel comprising pixels arranged in a hexagonal structure according to an embodiment of the present invention.

DETAILED DESCRIPTION OF EMBODIMENTS

Figure 1:
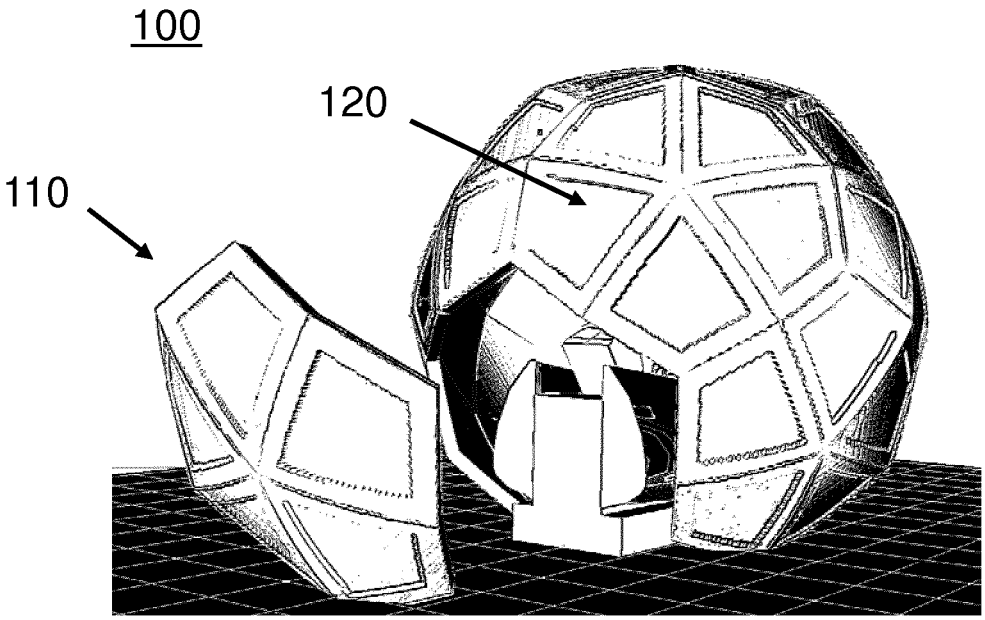
FIG. 1 is a perspective view of a spherical dome according to a first embodiment of the present invention, the spherical dome comprising a plurality of identical convex quadrilateral tiles or direct view displays curved in 1 direction.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The embodiments described hereunder relate to direct view displays. Direct view displays are visual displays which can be observed directly and present visual information according to the electrical input signal (analog or digital) either by emitting light (then they are called active displays) or, alternatively, by modulating available light during the process of reflection or transmission (light modulators are called passive displays). The term "direct view" relates originally to televisions having a CRT and a scanning electronic gun to "paint" an image on a phosphor coated screen which is then observed "directly". The term however now includes any active or passive electronic visual displays including fixed format displays such as LED displays, LCD displays, plasma displays, OLED displays, ET displays, etc.

The embodiments of the direct view visual system can have the light creating surface at the inside of the dome structure in case the viewer is inside the dome or at the outside for other applications where the users are outside of the dome.

In any of the embodiments of the present invention the image on the direct view dome display can be displayed at a frame rate synchronized with the shuttering frame rate of shutter glasses worn by the viewer or viewers to display alternating images for the left and right eye thus provide an additional depth cue for the viewer or viewers.

A quadrilateral is a polygon with four edges (or sides) and four vertices or corners. In embodiments of the present invention tiles in the form of convex quadrilaterals are used. In a convex quadrilateral, all interior angles are less than 180° and the two diagonals both lie inside the convex quadrilateral. In embodiments of the present invention the tiles may be flat, curved around one direction or curved around two directions such as two orthogonal directions. The term convex does not relate to the curvature of the tile but to all the corners having an interior angle less than 180° and the two diagonals both lying inside the convex quadrilateral.

If a space between direct view display tiles is filled to form an opaque seam or is open or transparent, the images presented to the viewer are disfigured, or disturbed or not like reality. In accordance with any of the embodiments of the present invention a seamless direct-view dome display and method of manufacture are provided.

FIG. 1 is a perspective view of a direct view curved or spherical dome display 100 according to a first embodiment of the present invention. The spherical dome can provide a horizontal field of view of up to 360° and a vertical field of view of minimum 0° to 30°, or even up to −50° to 90°, or zenith. This means that the total vertical view of the display is at least 30° but can be of course larger up to 140° for a truncated system, e.g. varying from −50° to +90° and up to 180° for a full dome, e.g. varying from −90° to +90°

The spherical dome is preferably truncated at the bottom, depending on the type of application for which it is being used. For example, it can be used as a simulation cockpit of an airplane, a vehicle or a train, in which case the bottom tiles can be removed to provide access to the inside of the dome.

The dome display 100 comprises a plurality of convex quadrilateral tiles, preferably identical convex quadrilateral tiles 120. The number of tiles depends on the number of tiles which are removed at the bottom or other parts of the dome display 100. As explained further below, the convex quadrilateral tiles of the dome according to embodiments of the present invention can be flat, curved in one direction (to have a cylindrical surface) or curved in two directions (barrel or spherical). It is preferred if the convex quadrilateral tiles of the dome according to embodiments of the present invention are curved in one direction (to have a cylindrical surface) or curved in two directions (barrel or spherical) when installed.

Embodiments of the present invention include screens which are curved or domed in shape but are not perfect spheres. They can be spheroidal domes. The convex quadrilateral tiles 120 can be flat, or more preferably curved in one direction or curved in two directions when installed. The embodiment of FIG. 1 shows convex quadrilateral tiles 120 curved in one direction, and the dome 100 is spherical, spheroidal or substantially spherical. Although in the embodiment of FIG. 1, the tiles 120 are curved in one direction, tiles 120 which are curved in two directions are included within the scope of the present invention.

As illustrated in FIG. 1, the spherical dome can have an articulated entrance door 110 comprising a plurality of convex quadrilateral tiles that are curved in one direction 120. In other embodiments, it is possible to enter the dome via a stair located inside the dome, or any other similar access system. The articulated entrance door 110 is preferably encapsulated in the dome. The entrance door 110 preferably comprises five convex quadrilateral tiles, preferably identical convex quadrilateral tiles arranged so as to form a pentagonal or substantially pentagonal shape, or three convex quadrilateral tiles, preferably identical convex quadrilateral tiles arranged so as to form a triangular or substantially triangular shape, given the curvature of the individual tiles.

Figure 2A:
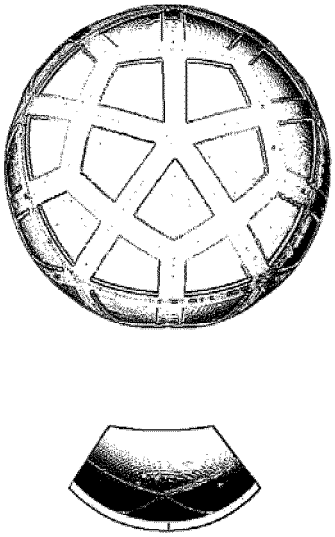
FIG. 2*a* is a top view of a spherical dome according to a second embodiment of the present invention, the spherical dome comprising a plurality of convex quadrilateral tiles, all the tiles being identical and curved in 2 directions.
Figure 2B:
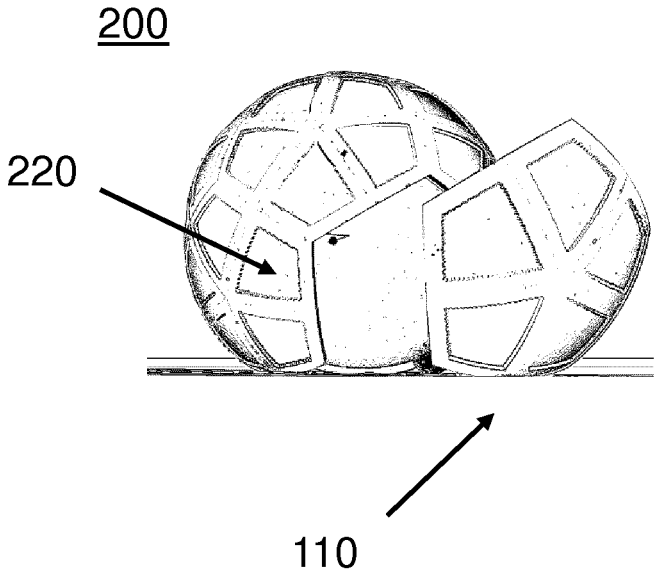
FIG. 2*b* is a perspective view of a spherical dome according to the second embodiment of the present invention shown in FIG. 2*a*.

FIG. 2*b* is a perspective view of a spherical dome 200 according to a second embodiment of the present invention, similar to FIG. 1. FIG. 2*a* is a top view of the same spherical dome 200 having an articulated entrance door 110 comprising a plurality of convex quadrilateral tiles that are curved in 2 directions. The horizontal field of view can also be more than 180° e.g. up to 360° and the vertical field of view from 0° to 30°, or even −50° to 90° or zenith. This means that the total vertical view of the display is at least 30° but can be larger for example up to 140° for a truncated system, e.g. varying from −50° to +90° and, e.g. up to 180° for a full dome such as varying from −90° to +90°.

The dome 200 comprises a plurality of convex quadrilateral tiles, preferably identical convex quadrilateral tiles 220 which are curved in two directions to provide a spherical or a spheroidal or an ellipsoidal surface. In this second embodiment, the shape of the tiles can be spherical, spheroidal, elliptical, toroidal or can be of a so called free form surface.

The dome of the second embodiment can also have an articulating entrance door 210 as in the first embodiment, said door comprising a plurality of convex quadrilateral tiles, preferably identical convex quadrilateral direct view panels or tiles 220 which are curved in two directions. The articulated entrance door 210 is also preferably encapsulated in the dome. The entrance door 210 preferably comprises five convex quadrilateral tiles, preferably identical convex quadrilateral tiles arranged to form a pentagonal or substantially pentagonal shape, or three convex quadrilateral tiles, preferably identical convex quadrilateral tiles arranged so as to form a triangular or substantially triangular shape, given the curvature of the individual tiles.

Figure 3:
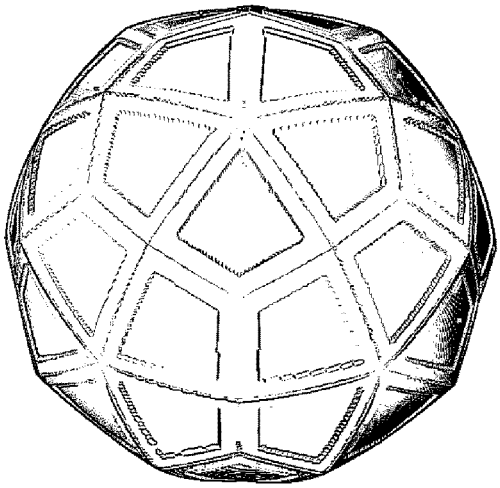
FIG. 3 is a perspective view of a complete spherical dome display according to the first embodiment of the present invention.

FIG. 3 is a perspective view of a complete spherical dome 100 according to the first embodiment of the present invention that has tiles 120 curved in one direction. The complete spherical dome 100 provides a horizontal field of view of at least 180° and up to 360° and a full vertical field of view of −90° to +90°. The complete spherical dome comprises sixty identical convex quadrilateral tiles 120.

Figure 4A:
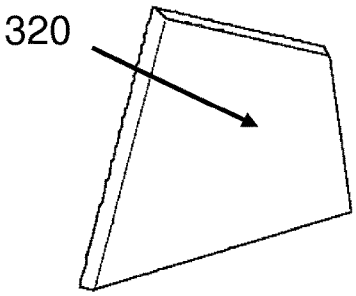
FIG. 4*a* shows a flat convex quadrilateral tile according to a third embodiment of the present invention.
Figure 4B:
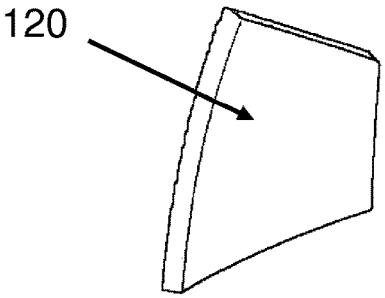
FIG. 4*b* shows a convex quadrilateral tile according to the first embodiment of the present invention, curved in one direction.
Figure 4C:
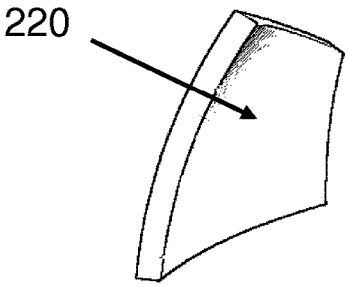
FIG. 4*c* shows a convex quadrilateral tile according to the second embodiment of the present invention, curved in two directions.

FIG. 4*a* shows a tile according to a third embodiment of the present invention. In this embodiment, each tile is a perfectly flat convex quadrilateral 320. FIG. 4*b* shows a tile according to the first embodiment of the present invention, i.e. curved in one direction. FIG. 4*c* shows a tile according to the second embodiment of the present invention, i.e. curved in two directions.

In the third embodiment, i.e. when the tiles are perfectly flat, the shape of the complete substantially spherical dome is a convex hexecontahedron having sixty identical flat faces, all in different planes.

A suitable convex hexacontahedron can be for use in any of the embodiments of the present invention:

a deltoidal hexacontahedron—having kite shaped direct view panels which are convex quadrilaterals, a pentagonal hexecontahedron—having pentagonal direct view panels which are similar to convex quadrilaterals, a triakis icosahedron—having isosceles triangular direct view panels, a pentakis dodecahedron—having isosceles triangular direct view panels.

Of these the deltoidal or the pentagonal are preferred.

Figure 5:
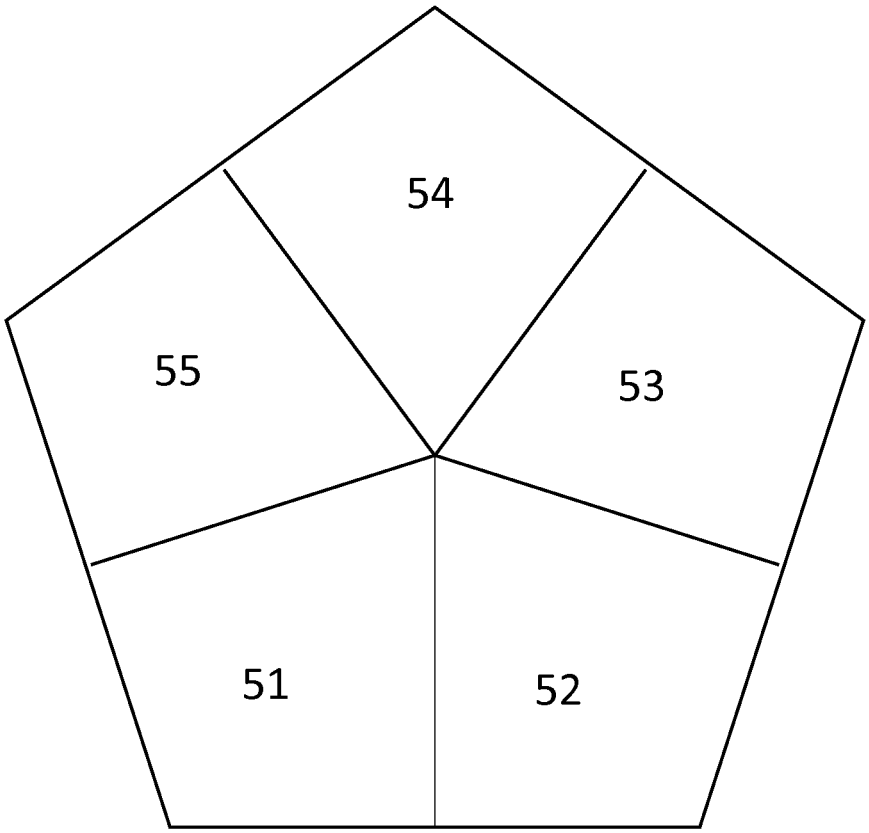
FIG. 5 shows the grouping of five identical tiles into a pentagon for use with embodiments of the present invention.
Figure 6:
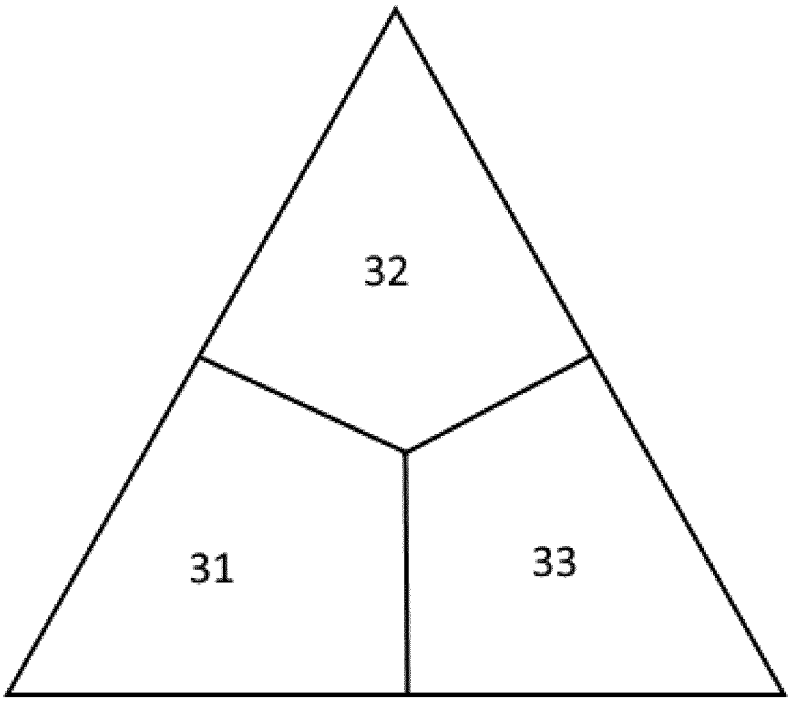
FIG. 6 shows the grouping of three identical tiles into a triangle for use with embodiments of the present invention.

Five convex quadrilateral tiles, preferably identical convex quadrilateral tiles can be grouped in a pentagonal shape, as shown in FIG. 5. Three convex quadrilateral tiles, preferably identical convex quadrilateral tiles can be grouped in a triangle, as shown in FIG. 6.

As for the first and second embodiment, the convex quadrilateral tiles are curved in one and/or two directions respectively, the curved convex quadrilateral tiles shapes can also be obtained by partitioning the sphere, spheroid or substantially spherical dome into spherical polyhedra analogously to the third embodiment, i.e. for a convex hexecontahedron. For the first embodiment, convex quadrilateral tiles that are said to be curved in one direction have a surface that is said to be sufficiently cylindrical. The principal axis of the cylinder can be parallel to the long or short diagonal or to any of the sides of the convex quadrilateral panel or have any orientation in between these directions. The tiles are preferably curved along the longer diagonal, as illustrated in FIG. 4*b*, in order to provide a final shape which is closer to that of a sphere.

As for the first and second embodiments, the spherical dome according to the third embodiment can have an articulated entrance door comprising a plurality of convex quadrilateral tiles that are flat 320. In other embodiments, it is possible to enter the dome via a stair located inside the dome, or any other similar access system. The articulated entrance door is also for the third embodiment preferably encapsulated in the dome. The entrance door preferably comprises 5 convex quadrilateral tiles, preferably identical convex quadrilateral tiles arranged to form a pentagon, or 3 convex quadrilateral tiles, preferably identical convex quadrilateral tiles arranged to form a triangle.

In all three embodiments, the complete spherical, spheroidal or substantially spherical dome can comprise sixty self-supporting convex quadrilateral tiles (or less if not completely spherical). It is an option for all embodiments that the dome has the shape of a convex hexaconahedron such as:

a deltoidal hexacontahedron—having kite shaped seamless direct view panels which are convex quadrilaterals, a pentagonal hexecontahedron—having pentagonal seamless direct view panels which are similar to convex quadrilaterals, a triakis icosahedron—having isosceles triangular seamless direct view panels, a pentakis dodecahedron—having isosceles triangular seamless direct view panels.

Of these the deltoidal or the pentagonal are preferred.

Referring back to FIGS. 1 and 2*b*, the encapsulated doors 110 and 210 preferably comprise five convex quadrilaterals arranged in a spheroidal, substantially spherical or spherical pentagon or three convex quadrilateral tiles arranged in a spheroidal, substantially spherical or spherical triangle. As discussed above, the same applies for the flat tiles of the third embodiment, in which case the encapsulated door comprises five tiles arranged in a pentagon or three tiles arranged in a triangle.

Also, the spherical (or substantially spherical e.g. spheroidal) dome is preferably truncated by removing a group of five convex quadrilaterals arranged in a spheroidal, substantially spherical or spherical or flat pentagon, for respectively the first, second and third embodiments. Thus, in this case, the truncated spherical dome comprises fifty five convex quadrilateral tiles. However, other numbers of tiles are possible by truncating in a different way and other arrangements are possible.

In any of the embodiments of the present invention the type of direct view technology on the convex quadrilateral panel can be monolithic or can consist of subparts to the level that it can consist of several sub-tiles or of individual light sources that are arranged within a convex quadrilateral configuration as described above.

The direct view technology can be made of tiles with any type of fixed format displays such as plasma, LCD, OLED, discrete LED, fluorescent displays or any other electronic visual display technology that can be viewed directly. The direct view display technology can display visual light such as red, green and blue light. Alternative configurations of tiles and domes can also include emissive tiles emitting non-visible light. An example is light emitted from the display tiles which requires specific goggles or other types of sensors. An example is infrared light which can be viewed with night vision goggles. Tiles for use in embodiments of the present invention can emit visible light and non-visible light such as infrared light.

Each of the convex quadrilateral direct view tiles can display the part of the image that corresponds to its location within the dome. The convex quadrilateral direct view display tiles receive the image content from one or more image generators through electrical cables or via wireless connections that connect to one or more inputs on the convex quadrilateral direct view tiles.

In any of the embodiments of the present invention the image on the direct view dome display can be displayed at a frame rate synchronized with the shuttering frame rate of shutter glasses worn by the viewer or viewers to display alternating images for the left and right eye thus provide an additional depth cue for the viewer or viewers.

Another important aspect of the present invention is the configuration of the pixel structure on each convex quadrilateral tile. The pixel configuration can be identical on each tile or can depend on the position of the tile in the spherical dome display.

FIG. 6 shows a convex quadrilateral tile having an orthogonal pixel structure, or a grid-like structure.

Figure 7:
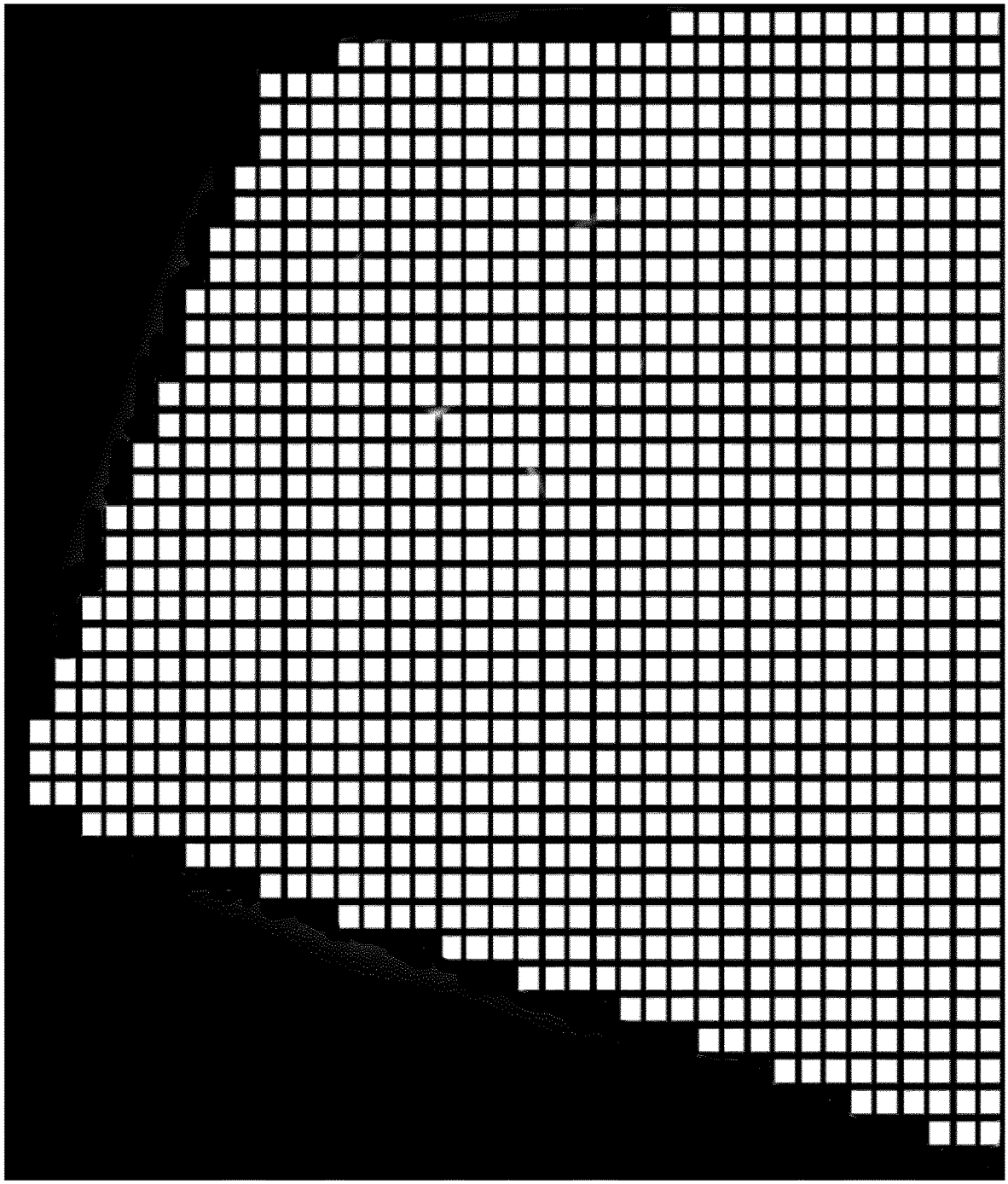
FIGS. 7 and 8 show a convex quadrilateral tile or direct view panel comprising pixels arranged in a grid structure according to embodiments of the present invention.
Figure 8:
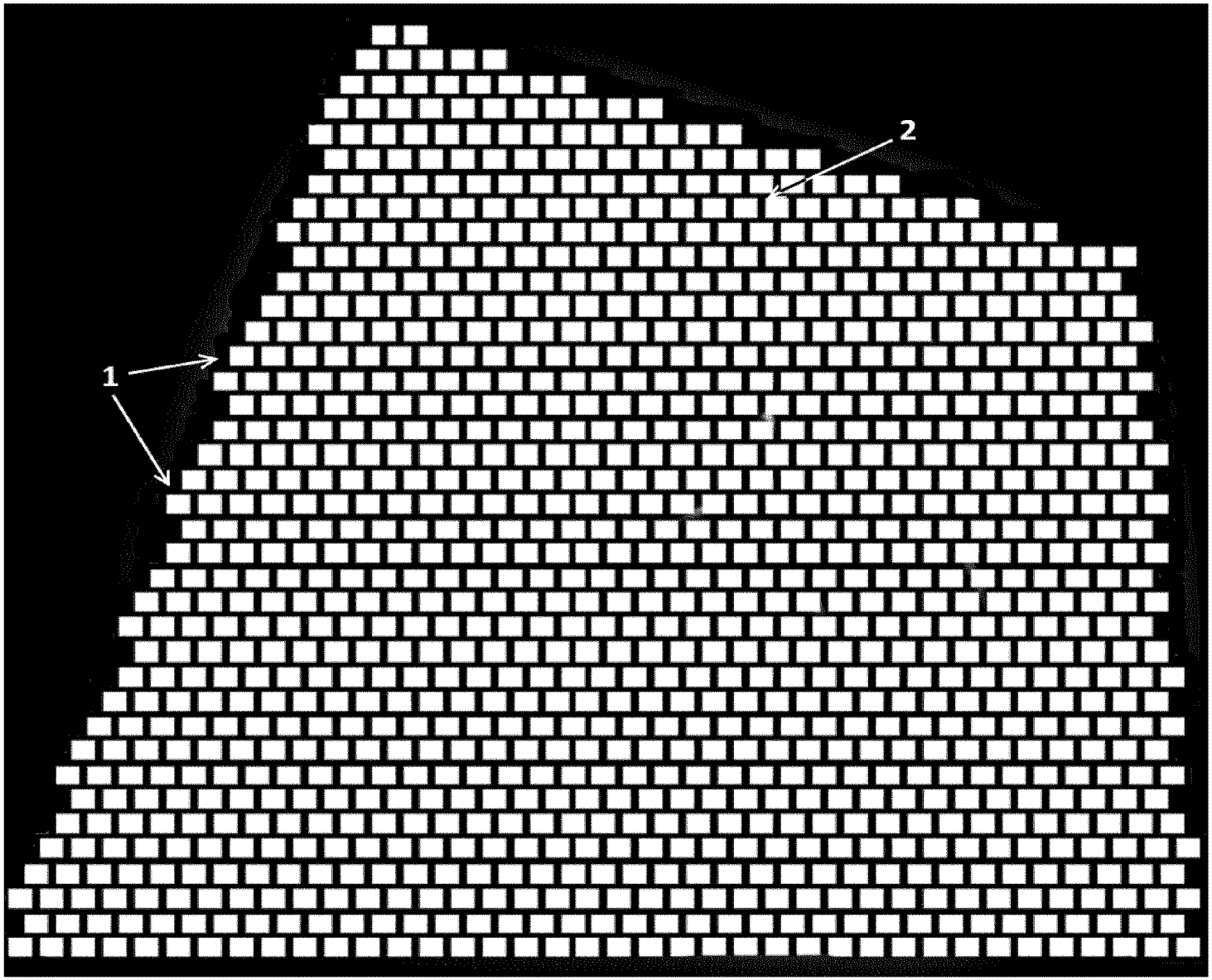

FIG. 7 shows a hexagonal structure wherein the pixels are vertically arranged in lines and each second line of pixels is shifted with respect to the preceding one. In the example shown in FIG. 7, a pixel in a second line is located in the middle between two pixels of the previous line.

Other arrangements are possible. The advantage of having a non-regular arrangement is that the pixel distribution can be adapted to the orientation of the sides of the convex quadrilateral tile, as shown for example in FIG. 7. This shows pixels 1 near the edge of the display (e.g. within 200, 100, 50, 30, or 20 pixels of an edge) with a lower density than pixels 2 near the center of the display (e.g. within 200, 100, 50, 30, or 20 pixels of the center).

The convex quadrilateral direct view tiles can have a hexagonal (as illustrated in FIG. 7), orthogonal or varying pixel structure to optimize the pixel distribution near the edges of the convex quadrilateral tile e.g. within 200, 100, 50, 30, or 20 pixels of an edge. The pixel structure is optimized to be as uniform as possible over the center of the panel as well as near the edges or the corner points where two or more panels are connected to each other. The pixels can individually be emitting visible light such as red, green, blue light or non-visible light wavelengths or can have a combined output of any of the former.

The pixels near the edge or corners of the convex quadrilateral direct view panel e.g. within 200, 100, 50, 30, or 20 pixels of an edge, can be driven at a higher brightness versus other pixels further away from the edge to compensate for the fact that the edges can be darker when the pixel structure near the edges is less dense then the pixel structure density closer to the middle of the convex quadrilateral direct view panel. The pixel size and number of pixels per convex quadrilateral direct view tile may vary depending upon the total required resolution of the display.

It is also possible to provide different types of pixel configurations on different tiles so as to minimize the gaps at the edges between two adjacent tiles. In this case, the pixel configuration will be close to orthogonal near the corners of the convex quadrilateral direct view tile that are close to 90° and will vary across the tile to a nearly hexagonal pixel configuration at the opposite corners that are substantially different from 90° e.g. 60°, 70°, 75°, 80°, 85, to match the edges near these corners e.g. within 200, 100, 50, 30, or 20 pixels of a corner, The pixel grid can be rotated between the five types of tiles. Thus the images displayed on the various tiles are differently rotated with respect to the grid. The image generation source needs to take into account the exact location of each tile in the dome and its rotation as is known to the skilled person of projection based systems.

The system with convex quadrilateral tiles allows building up an entire or a partial dome visual system. This depends upon the total field of view required for the system.

The direct view tiles can be connected together in a self-supporting way in case of a partial dome or can be fixed on or to a supporting structure. The tiles can be connected through one or more reference pins in the side edges of each tile that connect to one or more corresponding reference holes in the side edges of the adjacent connecting tile. The pins can either slide in and out of the edge of the tile or can be fixed in the edge of the tile. Additional locking screws can be used. Alternative methods can be used to make each tile abut with another so that there is no visible opaque or visible transparent seam. The tiles can be fastened together with fastening means such as pins and corresponding holes, nuts and bolts, adhesive. Especially fixtures may be applied to the back surface of a tile, i.e. on the surface hidden from the direct view surface, and these fixtures may be connected together using fastening means such as pin and holes, nuts and bolts, adhesive to bring together adjacent tiles.

In case of a self-supporting method, the tiles connect to a holder on the floor that has the corresponding reference pins and holders and that allow the bottom row of tiles to connect to this holder. The second row of tiles than connect to the first row of tiles and so on for the additional tiles of the system until the full configuration is constructed.

Alternatively, the tiles can be combined in groups of five to form a pentagonal combination and these pentagonal combinations are then positioned on top of the floor structure and fastened together e.g. pinned, bolted, adhered or screwed together in the same way as the individual tiles. Fastening methods can be used to make each combination abut with another so that there is no visible opaque or visible transparent seam between them. The pentagonal combinations can be connected through one or more reference pins in the side edges of each combination that connect to one or more corresponding reference holes in the side edge of the adjacent connecting combination. The pins can either slide in and out of the hole on the edge of the combination or can be fixed in the edge of the combination. Additional locking screws can be used. Alternative methods can be used to make each combination abut with another so that there is no visible opaque or visible transparent seam. The combinations can be fastened together with fastening means such as pins and corresponding holes, nuts and bolts, or adhesive. Especially fixtures may be applied to the back surface of a combination, i.e. on the surface hidden from the direct view surface, and these fixtures may be connected together using fastening means such as pins and corresponding holes, nuts and bolts, or adhesive to bring together adjacent pentagonal combinations.

When a non-self-supporting way of assembly is used, the tiles are connected on a supporting structure that fits around the actual system. This supporting structure can have a spherical envelope, a dodecahedron envelope, an icosahedron envelope or a convex hexecontahedron envelope or something sufficiently close to any of these shapes. The structural elements of the supporting structure can either be straight or curved. Generally, the supporting structure will be put up first and the tiles are fixed to this structure such as with bolts, pins, screws or adhesive or hung on this structure one at a time or in groups of three or five tiles. Alternative methods may also be used.

The display tiles of any of the embodiments of the present invention can comprise a display layer including where necessary a backlight and a drive electronics layer such as a backplane. Drive electronics for each tile can be provided behind the display layer. The electronics can be in the form of electronic components on a PCB for example these can be surface mounted components. To allow for curved tiles a flexible PCB may carry the electronic components. The PCB such as the flexible PCB can be provided with a power supply. The dome display according to any of the embodiments of the present invention preferably comprises a plurality of display tiles, each comprising a display layer and backplane and also a controller which preferably includes a processor either standalone or embedded in another device such as a microprocessor or an FPGA for example as well as volatile and non-volatile memory. The controller can be coupled to one or more display interface circuits for driving the pixel arrays of the display tiles.

In any of the embodiments of the present invention the drive electronics can be adapted to provide an image on the direct view dome display which is displayed at a frame rate synchronized with the shuttering frame rate of shutter glasses worn by the viewer or viewers to display alternating images for the left and right eye thus provide an additional depth cue for the viewer or viewers.

The non-volatile memory can store software such as processor control code to implement functions including an operating system and any communications interface. To do this the controller can access its non-volatile memory.

The controller can also receive image data for display from one or more other electronic devices, via a wired or wireless interface. The image data can come from image generators through electrical cables or via wireless connections that connect to one or more inputs on the convex quadrilateral direct view tiles. The image data may come from any other sources such as from cameras.

While the invention has been described hereinabove with reference to specific embodiments, this was done to clarify and not to limit the invention. The skilled person will appreciate that various modifications and different combinations of disclosed features are possible without departing from the scope of the invention.

The invention claimed is:

1. A direct-view dome display comprising a plurality of supported identical convex quadrilateral tiles, each tile providing a direct-view display, said tiles being arranged in at least one of a convex hexecontahedral configuration, a dodecahedral configuration or an icosahedral configuration to provide a spherical or spheroidal or substantially spherical dome, and a full or partial dome display over a horizontal field of view of at least 180° and a vertical field of view varying at least from 0° to 30°, totaling at least 30°, wherein the convex quadrilateral direct view tiles have a varying pixel structure which optimizes a pixel distribution near edges of the convex quadrilateral tile, the varying pixel configuration being orthogonal or close to orthogonal near corners of the convex quadrilateral direct view tile that are at 90° or close to 90° and varying across the tile to a hexagonal pixel configuration or nearly hexagonal pixel configuration at opposite corners that are different from 90° or substantially different from 90° to match the edges near these corners.

2. Direct-view dome display according to claim 1, wherein the identical convex quadrilateral tiles are self-supporting or further comprise a support structure for supporting at least lower tiles of the dome.

3. Direct-view dome display according to claim 2, wherein the support structure is a floor support structure at least partially in the shape of a ring and having a mechanical interface configured to connect to the lower convex quadrilateral tiles, and wherein the remainder of the tiles are connected together in a self-supporting way or wherein the tiles are connected together and to the floor support structure through one or more connectors having reference pins provided in side edges of each tile or of the support structure that connect to one or more corresponding reference holes in the side edges of the adjacent connecting tile or support structure or are connected by adhesive, screws, or bolts.

4. Direct-view dome display according to claim 3, wherein the plurality of identical convex quadrilateral tiles is combined in groups of five to form a pentagonal combination or in groups of three to form a triangular combination, and these pentagonal or triangular combinations are then positioned on top of the floor support structure and fixed together by a fastening means or by adhesive, screws, bolts or fixed together by means of one or more reference pins provided in the side edges of the pentagonal or triangular combination or of the support structure that connect to one or more corresponding reference holes in the side edges of the adjacent pentagonal or triangular combination or support structure.

5. Direct-view dome display according to claim 2, wherein the dome or the support structure is at least partially in the shape of a sphere, a dodecahedron, an icosahedron or a convex hexecontahedron or a shape substantially similar to any of the preceding shapes over a horizontal field of view of at least 180° and a vertical field of view of at least 0° to 30° totaling at least 30°, the plurality of identical convex quadrilateral tiles being fixed to the support structure to provide a spheroidal, substantially spherical or a spherical full or partial dome display over the field of view.

6. Direct-view dome display according to claim 2, wherein the tiles are connected to or hung from the support structure individually, in groups of three in a triangular configuration or in groups of five in a pentagonal configuration.

7. Direct-view dome display according to claim 1, wherein the convex quadrilateral tiles are curved in one direction or the convex quadrilateral tiles are curved in two directions, or wherein the convex quadrilateral tiles are partly spherical, elliptical, spheroidal, toroidal or have a freeform, or wherein the convex quadrilateral tiles are manufactured in a flat plane out of a flexible material and in an installed condition are curved in one or two directions or wherein the convex quadrilateral tiles are manufactured in a flat plane out of a flexible material and are subsequently curved so they are installed as a partly spherical, elliptical, spheroidal, toroidal shape or have a freeform.

8. Direct-view dome display according to claim 1, wherein said dome comprises an articulated entrance door, comprising one or multiple tiles, or wherein said dome comprises an entrance door encapsulated in said dome or wherein said dome comprises an entrance door with three or five tiles arranged in a triangular or pentagonal configuration.

9. Direct-view dome display according to claim 1, wherein the dome is a complete sphere or spheroid or substantially complete sphere and comprises 60 identical tiles and/or wherein the dome is truncated.

10. Direct-view dome display according to claim 1, wherein the convex quadrilateral tiles each have an image forming direct view layer at the inside of the direct-view dome display or wherein the image forming direct view layer is at the outside of the direct-view dome.

11. Direct-view dome display according to claim 1, wherein pixels near an edge of the convex quadrilateral tile are driven at a higher brightness versus other pixels further away from the edge to compensate for the fact that the edges can be darker when the pixel structure near the edges is less dense then the pixel structure density closer to the middle of the convex quadrilateral tile.

12. Direct-view dome display according to claim 11, wherein the convex quadrilateral tiles are monolithic, being that they are made in a single piece or wherein the direct view tiles are made up of several sub-tiles that are arranged within a convex quadrilateral configuration or wherein the direct view tiles are made up of individual light sources that are arranged within a convex quadrilateral configuration.

13. Direct-view dome display according to claim 1, wherein the tiles emit red, green, blue or non-visible light wavelengths or can have a combined output of any of these or wherein each tile displays a part of the image that corresponds to its location within the dome.

14. Direct-view dome display according to claim 1, wherein pixels at an edge or corners or near the edge or corners of the convex quadrilateral tiles are driven at a higher brightness compared with other pixels further away from the edge of the direct view tile.

15. Direct-view dome display according to claim 1, wherein the image on the direct view dome display is displayed at a frame rate synchronized with a shuttering frame rate of shutter glasses worn by a viewer or viewers to display alternating images for a left and right eye of the viewer or viewers and thus provide an additional depth cue for the viewer or viewers.

16. Direct-view dome according to claim 1, wherein the tiles are arranged in a deltoid hexecontahedral configuration, and wherein each convex quadrilateral tile is kite shaped.

17. A method of operating a direct-view dome display comprising a plurality of identical convex quadrilateral tiles, each tile being a direct-view display, said tiles being arranged in at least one of a convex hexecontahedral configuration, a dodecahedral configuration or an icosahedral configuration, to provide a spherical, spheroidal or substantially spherical dome, and a full or partial dome display over a horizontal field of view of at least 180° and a vertical field of view of at least 0° to 30°, totaling at least 30° vertical field of view, wherein the convex quadrilateral direct view tiles have a varying pixel structure which optimizes a pixel distribution near edges of the convex quadrilateral tile, the varying pixel configuration being orthogonal or close to orthogonal near corners of the convex quadrilateral direct view tile that are at 90° or close to 90° and varying across the tile to a hexagonal pixel configuration or nearly hexagonal pixel configuration at opposite corners that are different from 90° or substantially different from 90° to match the edges near these corners, a support structure for supporting at least the lower tiles of the dome, the method comprising driving each of the identical convex quadrilateral tiles with image data to provide a combined image.

18. The method according to claim 17, wherein pixels near an edge of the convex quadrilateral tile are driven at a higher brightness versus other pixels further away from the edge to compensate for the fact that the edges can be darker when the pixel structure near the edges is less dense then the pixel structure density closer to the middle of the convex quadrilateral tile.

* * * * *